US011116380B2

(12) United States Patent
Fischer et al.

(10) Patent No.: US 11,116,380 B2
(45) **Date of Patent: *Sep. 14, 2021**

(54) DISHWASHER WITH A PIVOT SYSTEM FOR A DISH RACK

(71) Applicant: WHIRLPOOL CORPORATION, Benton Harbor, MI (US)

(72) Inventors: Marcus R. Fischer, Stevensville, MI (US); Christopher C. Wilcox, Stevensville, MI (US); Daniel S. Mead, Saint Joseph, MI (US); Jamie T. Weinert, Escanaba, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 504 days.

This patent is subject to a terminal disclaimer.

(21) Appl. No.: 16/183,809

(22) Filed: Nov. 8, 2018

(65) Prior Publication Data

US 2019/0069754 A1 Mar. 7, 2019

Related U.S. Application Data

(63) Continuation of application No. 15/058,231, filed on Mar. 2, 2016, now Pat. No. 10,123,677, which is a continuation of application No. 13/425,454, filed on Mar. 21, 2012, now Pat. No. 9,282,877.

(51) Int. Cl.

| | |
|---|---|
| ***A47L 15/26*** | (2006.01) |
| ***A47L 15/50*** | (2006.01) |
| ***A47L 15/42*** | (2006.01) |

(52) U.S. Cl.

CPC ..... *A47L 15/26* (2013.01); *A47L 15/50* (2013.01); *A47L 15/507* (2013.01); *A47L 15/4257* (2013.01)

(58) Field of Classification Search

None

See application file for complete search history.

(56) References Cited

U.S. PATENT DOCUMENTS

| | | | |
|---|---|---|---|
| 1,816,213 | A | 7/1931 | Duke |
| 3,087,769 | A | 4/1963 | Guth |
| 3,146,045 | A | 8/1964 | Kauffman |
| 3,321,261 | A | 5/1967 | Guth |
| 4,983,000 | A | 1/1991 | Rock |
| 5,115,822 | A | 5/1992 | Nichols |

(Continued)

FOREIGN PATENT DOCUMENTS

| | | | |
|---|---|---|---|
| DE | 102010043272 | A1 | 5/2012 |
| EP | 1066789 | B1 | 4/2004 |

(Continued)

OTHER PUBLICATIONS

German Search Report for counterpart DE102013100689, dated Apr. 30, 2013.

*Primary Examiner* — Rita P Adhlakha

(74) *Attorney, Agent, or Firm* — Nyemaster Goode, P.C.

(57) ABSTRACT

A dishwasher has a tub defining a wash chamber with an open face, a pivoting door having an open position and a closed position, a slide system having a first rail including a transition element, a second rail slidably interconnected with the first rail for relative sliding, and a dish rack rotatably connected to the slide system by a pivot system. The pivot system is attached to the transition element to cooperatively pivot with the door as the door is moving from the open position to the closed position.

19 Claims, 7 Drawing Sheets

(56) References Cited

U.S. PATENT DOCUMENTS

| | | | |
|---|---|---|---|
| 5,971,513 | A | 10/1999 | Cassalia |
| 7,594,513 | B2 | 9/2009 | Vanderroest et al. |
| 7,621,605 | B2 | 11/2009 | Bond et al. |
| 7,628,461 | B2 | 12/2009 | Carden et al. |
| 7,731,805 | B2 | 6/2010 | Banta et al. |
| 7,775,378 | B2 | 8/2010 | Tynes et al. |
| 2004/0163687 | A1 | 8/2004 | Son et al. |
| 2008/0210274 | A1 | 9/2008 | Vanderroest et al. |
| 2012/0104914 | A1 | 5/2012 | Jobst et al. |
| 2012/0248958 | A1 | 10/2012 | Ertz et al. |

FOREIGN PATENT DOCUMENTS

| | | | |
|---|---|---|---|
| EP | 1744656 | B1 | 3/2009 |
| GB | 1028203 | A | 5/1966 |

DISHWASHER WITH A PIVOT SYSTEM FOR A DISH RACK

CROSS REFERENCE TO RELATED APPLICATIONS

This application is a continuation of and claims priority to U.S. patent application Ser. No. 15/058,231, filed on Mar. 2, 2016, entitled "DISHWASHER WITH A PIVOT SYSTEM FOR A DISH RACK," pending. U.S. patent application Ser. No. 15/058,231 is a continuation of and claims priority to U.S. patent application Ser. No. 13/425,454, filed on Mar. 21, 2012, entitled "DISHWASHER WITH A PIVOT SYSTEM FOR A DISH RACK," now U.S. Pat. No. 9,282,877, the disclosures of which are hereby incorporated herein by reference in their entireties.

BACKGROUND OF THE INVENTION

A dish rack of a dishwasher is frequently extended out of the dishwasher by pulling it on wheels that roll across the inner surface of the open door. The action of closing the door while the dish rack overlies a portion of the door may inhibit the closing of the door because of the weight of the loaded dish rack and/or the binding of the dish rack relative to the door as the dish rack is designed to roll on a horizontal surface. If sufficient force is applied to the door to overcome the weight of the loaded dish rack, the dish rack may slide very quickly backward until encountering a stop, such as wheel stops or the rear wall of the tub, which may jostle the rack and its contents, increasing the likelihood of the items becoming improperly positioned for cleaning or the dish rack skewing or racking in such a manner to inhibit door closure or proper cleaning.

Where a rail system is utilized for the dish rack, the problems may be exacerbated in that movement of the door may cause binding of the rails. When an attempt is made to close the door before the rack is fully retracted into the dishwasher, contact of the door with an extended rail section, particularly with a telescopic rail configuration, may tend to force the extended rail section upward, causing the telescopic rails to bind, and preventing the movement of either the door or the rail.

BRIEF DESCRIPTION OF THE INVENTION

In one embodiment, a dishwasher has a tub defining a wash chamber with an open face, a pivoting door having an open position and a closed position, a slide system having a first rail including a transition element, a second rail slidably interconnected with the first rail for relative sliding, and a dish rack rotatably connected to the slide system by a pivot system. The pivot system is attached to the transition element to cooperatively pivot with the door as the door is moving from the open position to the closed position.

In another embodiment, a dish rack for a dishwasher includes a slide system with a first rail including a transition element and a second rail. The first rail and the second rail are slidably interconnected for relative sliding. A pivot system rotationally attaches the dish rack to the slide system. The pivot system is operably attached to the transition element and to cooperatively pivot with a dishwasher door as the dishwasher door is moving from an open position to a closed position.

In yet another embodiment, a moveable rack for an appliance has a rack having opposite side walls, a slide system having a first rail including a transition element, a second rail slidably interconnected with the first rail for relative sliding, a pivot system rotationally coupling the rack to the slide system with a first pivot coupling coupled to one of the opposite side walls and a second pivot coupling coupled to the slide system. The first and second pivot couplings connect to provide relative pivoting of the rack and slide system. The pivot system is attached to the transition element to cooperatively pivot with an appliance door as the appliance door is moving from an open position to a closed position.

DESCRIPTION OF EMBODIMENTS OF THE INVENTION

Figure 1:
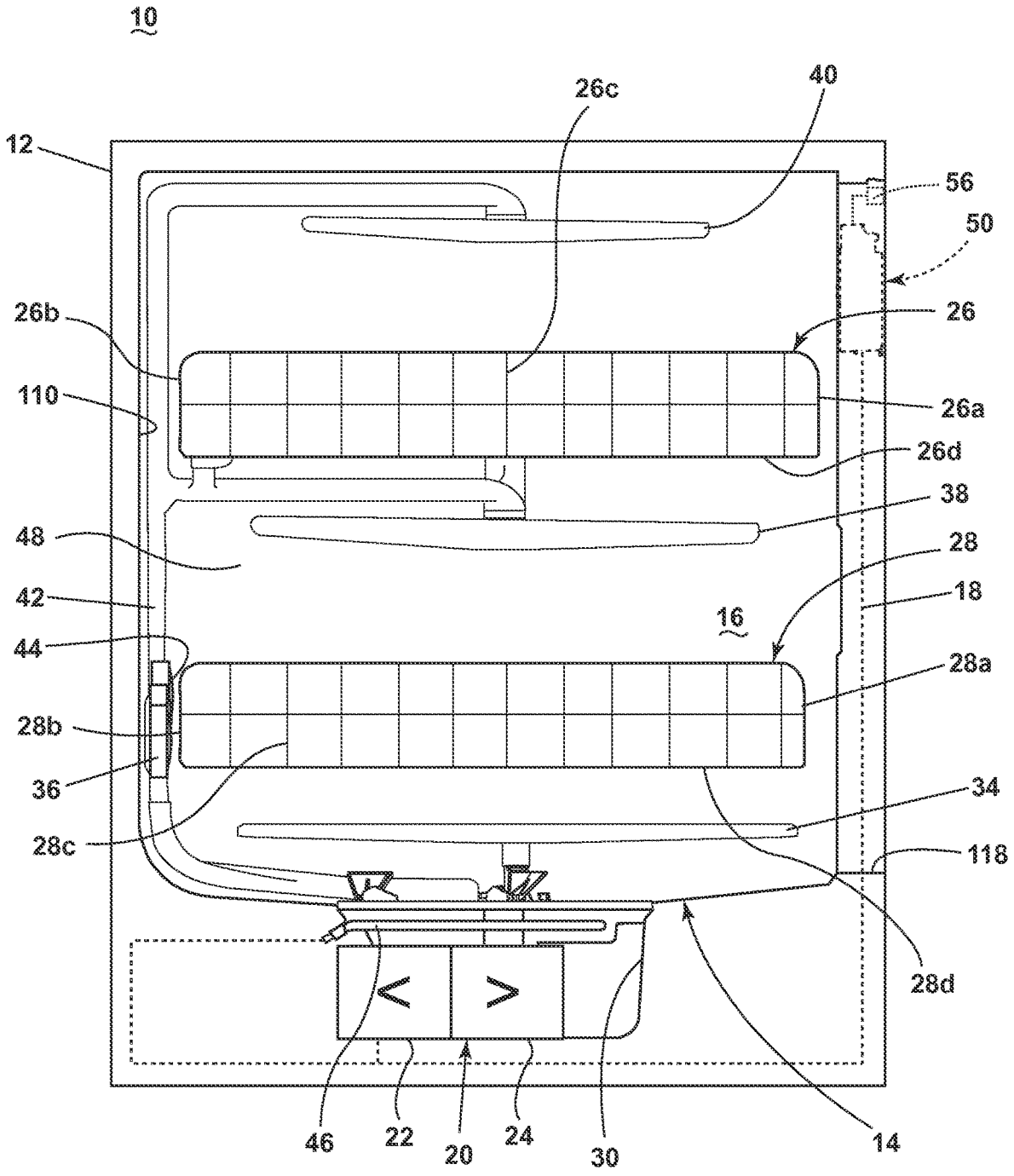
FIG. 1 is a schematic, cross-sectional view of a dishwasher according to an embodiment of the invention.

In FIG. 1, an automated dishwasher 10 is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 having side walls 48 may be provided within the chassis 12, and may at least partially define a treating chamber 16, having an open face 118 defining an access opening, for washing dishes. A door assembly 18 may be movably mounted to the dishwasher 10 for movement between opened and closed positions to selectively open and close the open face 118. Thus, the door assembly 18 provides accessibility to the treating chamber 16 for the loading and unloading of dishes or other washable items. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, respectively, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

The dish racks 26, 28 may be a wireframe structure having a front wall 26*a*, 28*a*, a rear wall 26*b*, 28*b*, a pair of opposing side walls 26*c*, 28*c*, and a bottom wall 26*d*, 28*d*. When the racks 26, 28 are received within the treating chamber 16, the front wall 26*a*, 28*a* may be adjacent the open face 118 and the rear wall 26*b*, 28*b* may be adjacent the back wall 110 of the tub 14.

A spray system may be provided for spraying liquid in the treating chamber 16 and may be provided in the form of a first lower spray assembly 34, a second lower spray assembly 36, a mid-level spray assembly 38, and/or an upper spray assembly 40. Upper spray assembly 40, mid-level spray assembly 38, and lower spray assembly 34 are located, respectively, above the upper rack 26, beneath the upper rack 26, and beneath the lower rack 28, and are illustrated as rotating spray arms. The second lower spray assembly 36 is illustrated as being located adjacent the lower dish rack 28 toward the back wall 110 of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system may be provided for recirculating liquid from the treating chamber 16 to the spray system. The recirculation system may include a sump 30 and a pump assembly 20. The sump 30 collects liquid sprayed in the treating chamber 16 and may be formed by a sloped or recessed portion of a bottom wall of the tub 14. The pump assembly 20 may include both a drain pump 22 and a recirculation pump 24. The drain pump 22 may draw liquid from the sump 30 and pump the liquid out of the dishwasher 10 to a household drain line (not shown). The recirculation pump 24 may draw liquid from the sump 30, and the liquid may be simultaneously or selectively pumped through a supply tube 42 to each of the spray assemblies 34, 36, 38, 40 for selective spraying. Though not shown, a liquid supply system may be fluidly coupled with the recirculation system, and may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located elsewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50, and receive information.

Figure 2:
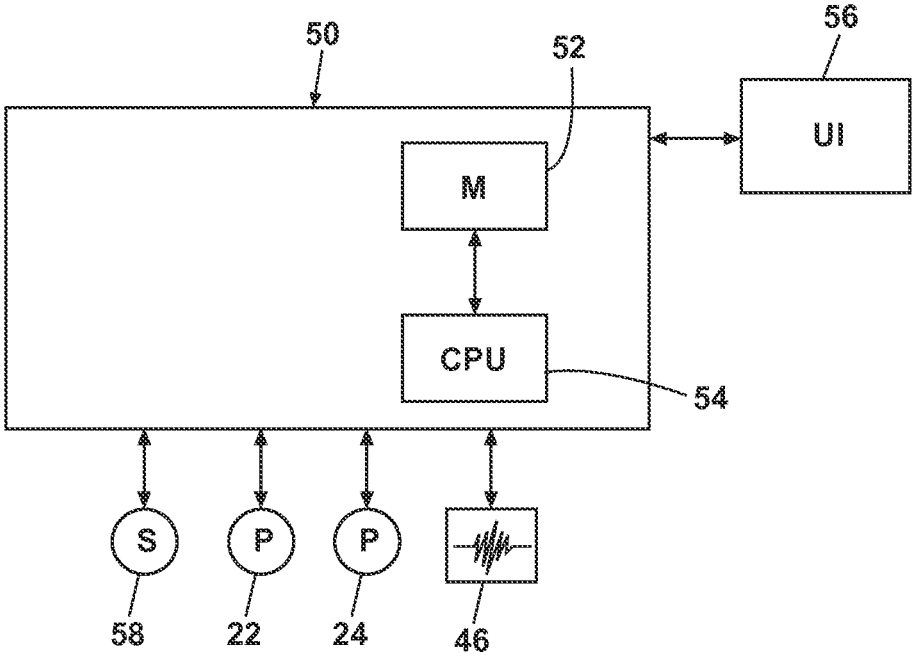
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 22 for draining liquid from the treating chamber 16, and the recirculation pump 24 for recirculating the wash liquid during a cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and a turbidity sensor to determine the soil load associated with a selected grouping of dishes, such as the dishes associated with a particular area of the treating chamber.

Figure 3:
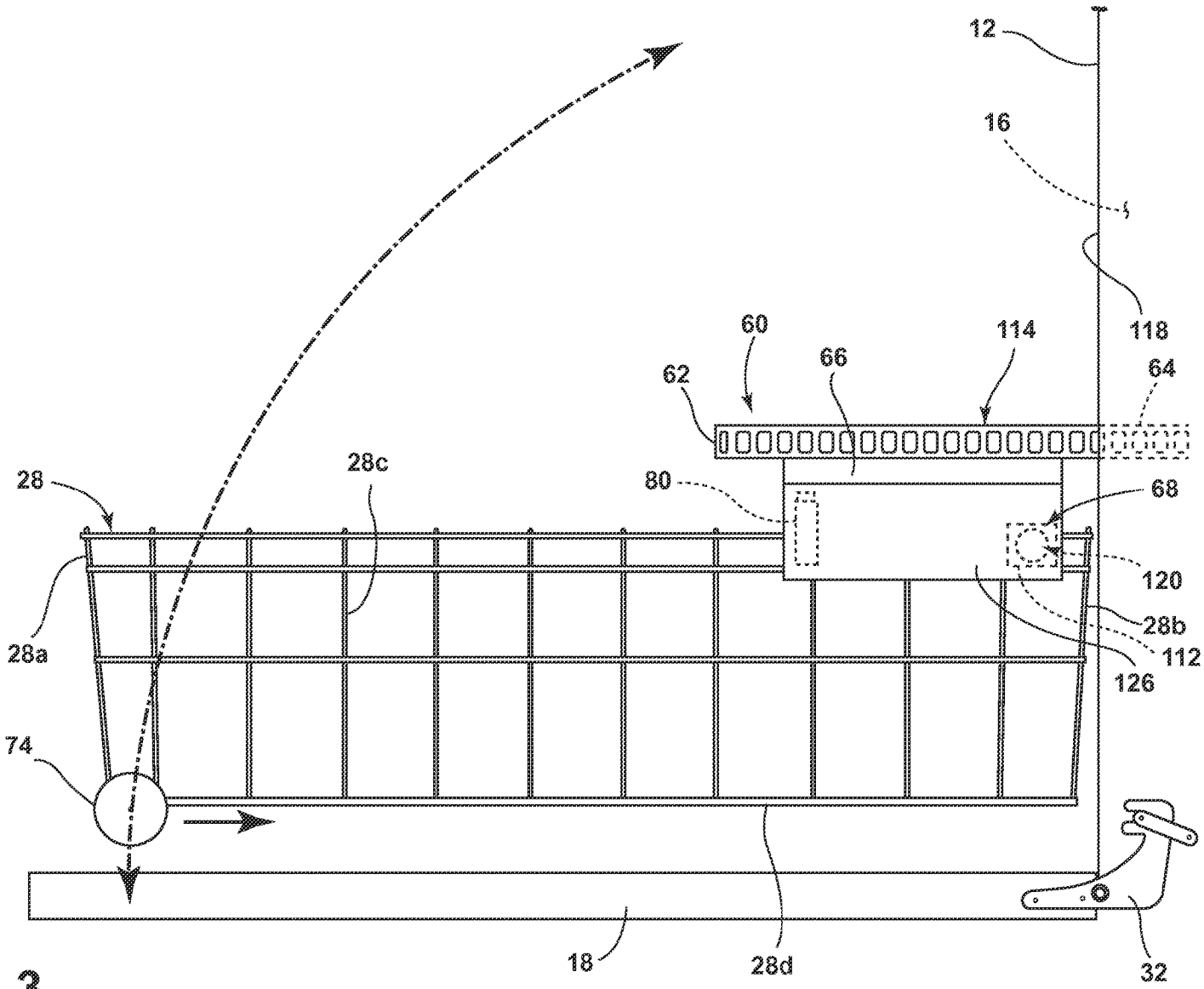
FIG. 3 is a schematic elevation view of a portion of a dishwasher including a dish rack incorporating a dish rack pivot system in an unpivoted configuration according to a first embodiment of the invention.

FIGS. 3-6 illustrate a first embodiment of a dish rack pivot system for use in the dishwasher 10 that enables the pivoting of the dish rack with the door. Referring to FIG. 3, the door assembly 18 may be secured to the lower front edge of the chassis 12 or to the lower front edge of the tub 14 via a hinge assembly 32 configured to pivot the door as illustrated by the arcuate arrow. The first embodiment is described in detail and is illustrated as including a slide system 60 and a pivot system 68, which are shown coupling the lower dish rack 28 to the tub in a manner to enable the relative pivoting of the lower dish rack 28 and the door assembly 18. While the upper dish rack 26 is omitted for purposes of clarity, it should be noted that the pivot system 68 may be applied to the upper dish rack 26 as well as the lower dish rack 28.

Figure 4:
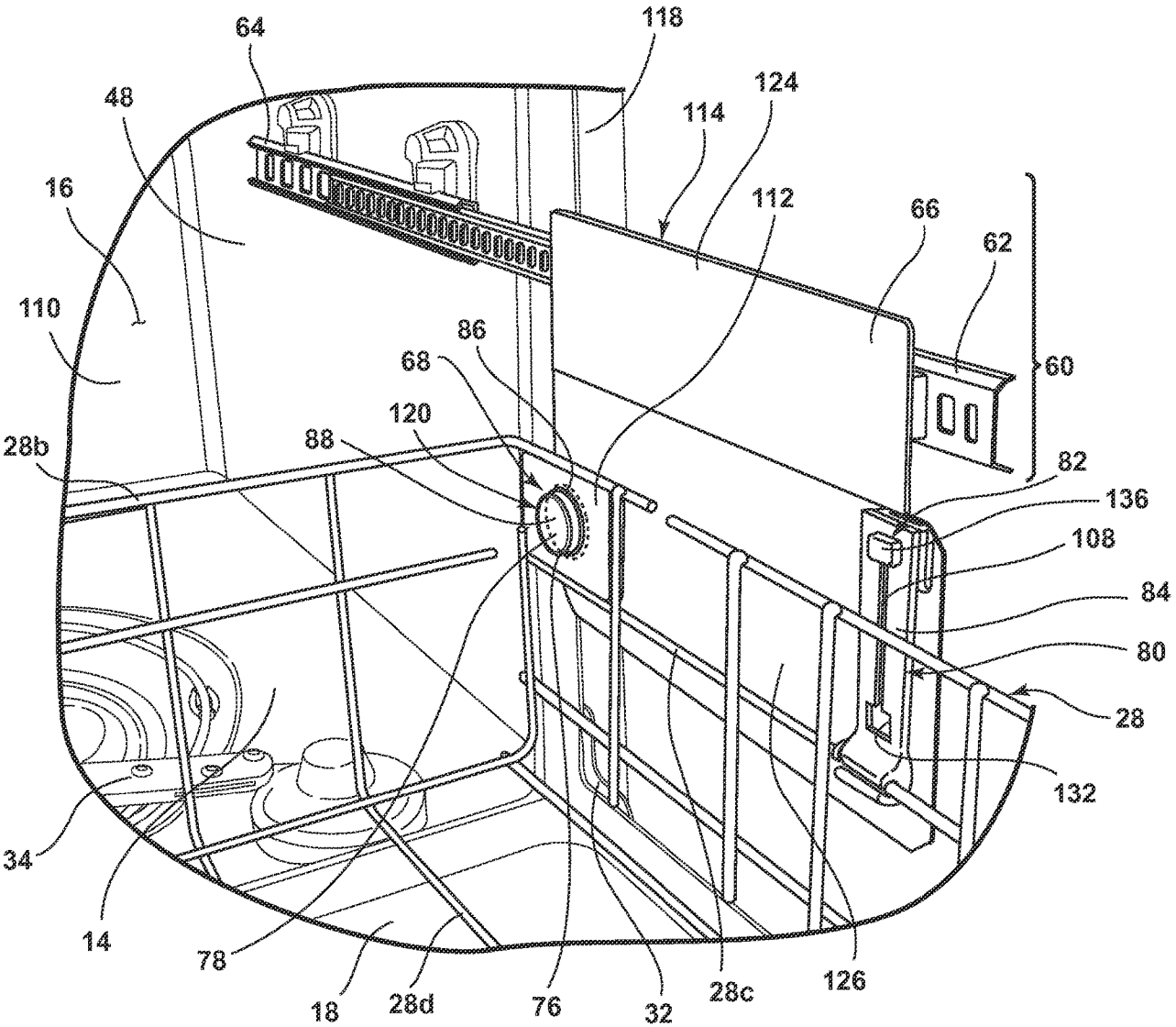
FIG. 4 is an enlarged perspective view of a portion of the dishwasher illustrated in FIG. 3 showing the dish rack, a slide system, and the pivot system, attached to the dish rack in an unpivoted configuration according to the first embodiment of the invention.
Figure 5:
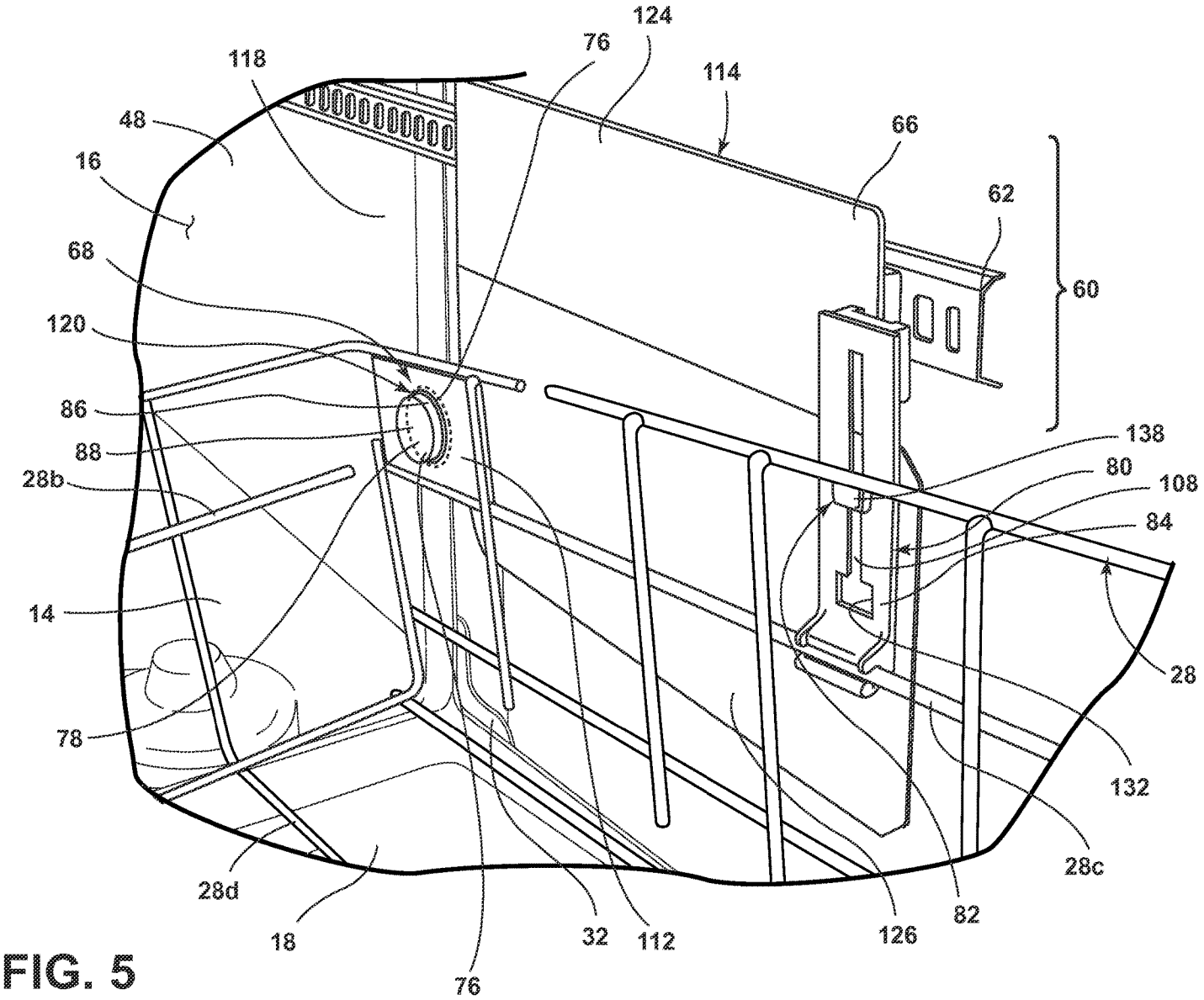
FIG. 5 is an enlarged perspective view of the dishwasher illustrated in FIG. 4 showing the dish rack, slide system, and pivot system in a pivoted configuration according to the first embodiment of the invention.

Referring also to FIG. 4, the slide system 60 may comprise a pair of slide system assemblies, which may be mirror-images of each other, each of which may be attached horizontally to a side wall 48 of the tub 14. Since each slide system assembly operates in the same manner, only 1 slide system assembly 114 is illustrated and described. The slide system assembly 114 may include a first rail 62 and a second rail 64 in telescopic disposition, and a transition element 66. The second rail 64 may be fixedly attached to a side wall 48 of the tub 14 within the treating chamber 16, and may telescopically support the first rail 62 to enable the first rail 62 to slidably move into and out of the treating chamber 16.

The transition element 66 may be a generally bracket-like or plate-like body including a first portion 124 adapted for coupling with the first rail 62, and a second portion 126 adapted for coupling with a side wall 28*c* of the dish rack 28. The first portion 124 may be coupled with the first rail 62 through any suitable means having sufficient strength and durability for the purposes described herein. For example, the first portion 124 may be coupled with the first rail 62 through fasteners, such as threaded fasteners, rivets, snap fittings, and the like, by welding, by integrating the first portion 124 into the first rail 62, or through an assembly of rollers or bearings adapted for movement of the transition element 66 along the first rail 62.

The second portion 126 may be coupled with the dish rack 28 through the pivot system 68. The pivot system 68 may comprise a pair of pivot assemblies 120, which may be mirror-images of each other. Since each pivot assembly operates in the same manner, only 1 pivot assembly 120 is illustrated and described. The pivot assembly 120 may include first and second pivot couplings 76, 78, which pivotally couple the dish rack to the slide system assembly 114. The first pivot coupling 76 is illustrated as a plate 112 affixed to the rack with an annular hub 86. The second pivot coupling 78 is illustrated as an axle 88 affixed to the transition element 66 and extending therefrom to be received within the annular hub 86, whereby the axle 88 may rotate within the hub 86 to provide for relative pivoting between the rack and the slide assembly. The hub 86 and axle 88 may be adapted with dimensions such that the outer diameter of the axle 88 is somewhat less than the inner diameter of the hub 86 so that the axle 88 may slidably pivot within the hub 86 with minimal wobble. The axle 88 may be provided with a low friction sleeve (not shown) to facilitate pivoting of the axle 88 within the hub 86.

One of the hub 86 and the axle 88 may be fixedly coupled with the second portion 126 of the transition element 66, toward a rear portion thereof (i.e. adjacent the rack rear wall 28*b*), and the other of the hub 86 and the axle 88 may be fixedly coupled with a side wall 28*c* of the dish rack 28. FIG. 4 illustrates an example of the hub 86 coupled with and extending orthogonally from the pivot plate 112, which may be fixedly coupled with the side wall 28*c* near the rear wall 28*b*.

The pivot plate 112 may include a circular opening (not shown) coaxially aligned with the attached hub 86. The hub 86 may be coupled with the pivot plate 112, and the pivot plate 112 with the side wall 28*c*, through any suitable means such as welding, fasteners, clips, or clamps, or by integrating the pivot plate 112 with the side wall 28*c* during manufacturing of the dish rack 28. The axle 88 may be coupled with the second portion 126 through any suitable means such as welding, casting, fasteners, and the like. In this configuration, the axle 88 may extend from the transition element 66 into the hub 86 for relative pivoting.

An optional vertical slider 80 may further couple the dish rack side wall 28*c* with the second portion 126 of the transition element 66 while enabling the pivoting action described above. The slider 80 may comprise a pin 82 and a channel element 84. The channel element 84 may be an elongate rectangle-shaped plate-like body having a slot 108 extending longitudinally therealong, stopping short of each end of the channel element 84. A first end of the slot 108 may terminate in a rectangular opening 132 oriented transversely to the longitudinal slot 108. The channel element 84 may be fixedly coupled with the side wall 28*c* of the dish rack 28 through clips, clamps, welding, and the like, so that the slot 108 extends along the side wall 28*c* perpendicular to the top thereof. The pivot assembly 120 and the channel element 84 may be located at horizontally opposite ends, respectively, of the transition element 66.

The pin 82 may be an elongate, somewhat T-shaped member adapted for slidable engagement with the channel element 84. The pin 82 may be rigidly attached, such as by welding, perpendicular to the second portion 126 of the transition element 66. The pin 82 may terminate in a perpendicularly attached, transversely oriented flange 136 adapted for insertion through the opening 132 so that the pin 82 may slide along the slot 108, held to the channel element 84 by the flange 136.

When assembled, the first rail 62 of each slide system assembly 114 may be coupled with the first portion 124 of each transition element 66, which may extend from the first rail 62 in a downward orientation to approach the side walls 28*c* of the lower dish rack 28. The pivot assemblies 120, 122 may couple the second portion 126 of each transition element 66 with the side walls 28*c* of the lower dish rack. The pin 82 extending perpendicularly from the second portion 126 may engage the slot 108 in the channel element 84 so that the pin 82 can slide generally vertically along the slot 108 as the dish rack 28 pivots about the pivot assemblies 120, 122 from an unpivoted position shown in FIG. 4 to a pivoted position shown in FIG. 5.

The dish rack 28 may effectively pivot upwardly about the axle 88, and while doing so, the pin 82 may slide downwardly along the slot 108. Pivoting of the dish rack 28 may be limited by contact of the pin 82 with the end of the slot 108.

Figure 6:
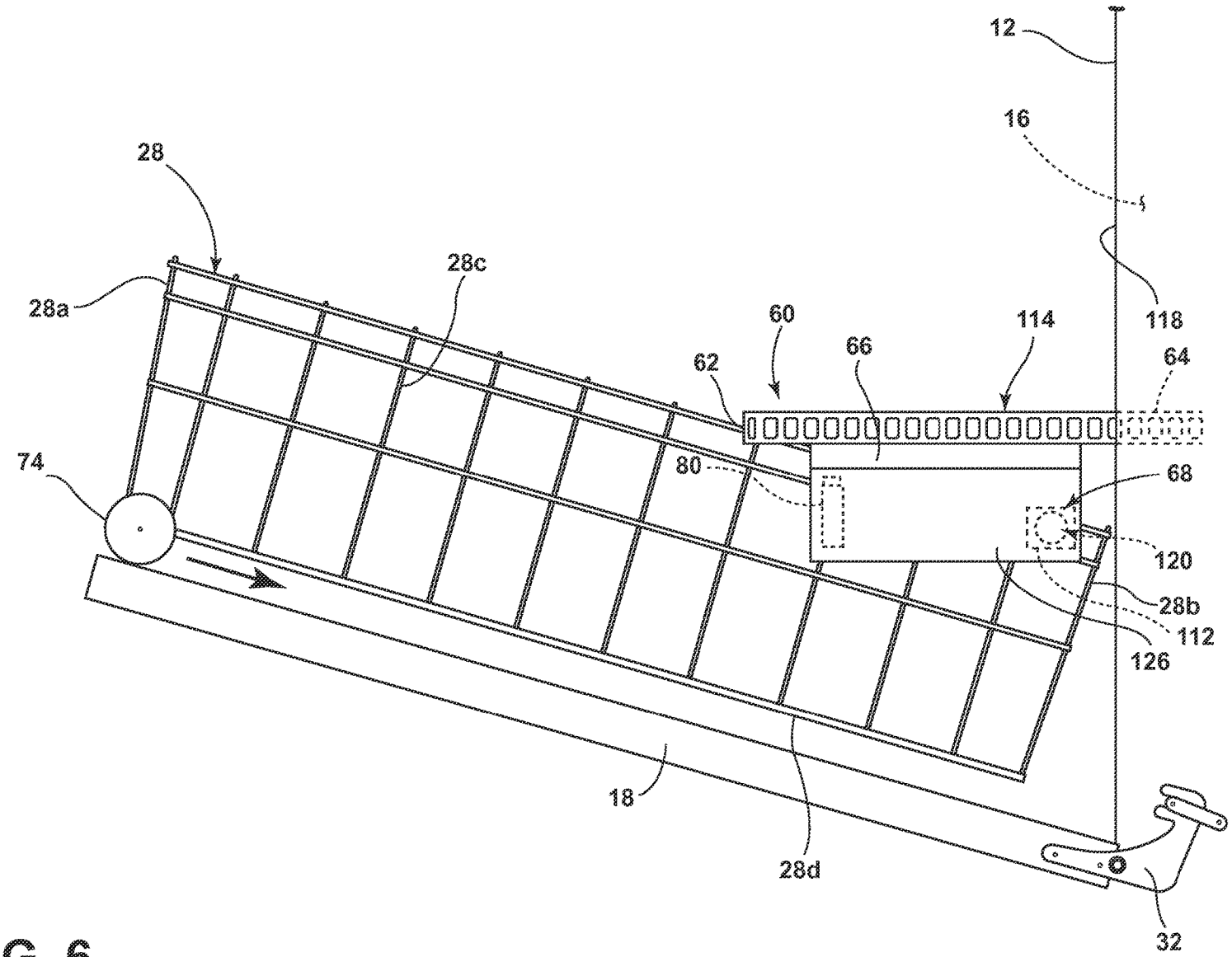
FIG. 6 is a schematic elevation view of the dishwasher of FIG. 3 showing the dish rack, pivot system, and slide system in a pivoted configuration.

Referring to FIG. 6, as the door 18 is lifted toward a closed vertical orientation, the lower dish rack 28 may be lifted with the door assembly 18 and may pivot about the pivot assembly 120. The front portion of the side walls 28*c* or bottom wall 28*d* of the dish rack 28 may be provided with a low friction contact element 74 for contact with an interior surface of the door assembly 18 to facilitate the sliding of the lower rack 28 along the door assembly 18. When the door assembly is in a horizontal, at-rest position, the dish rack 28 and contact element 74 may be suspended above the door assembly 18, as shown in FIG. 3.

Figure 7:
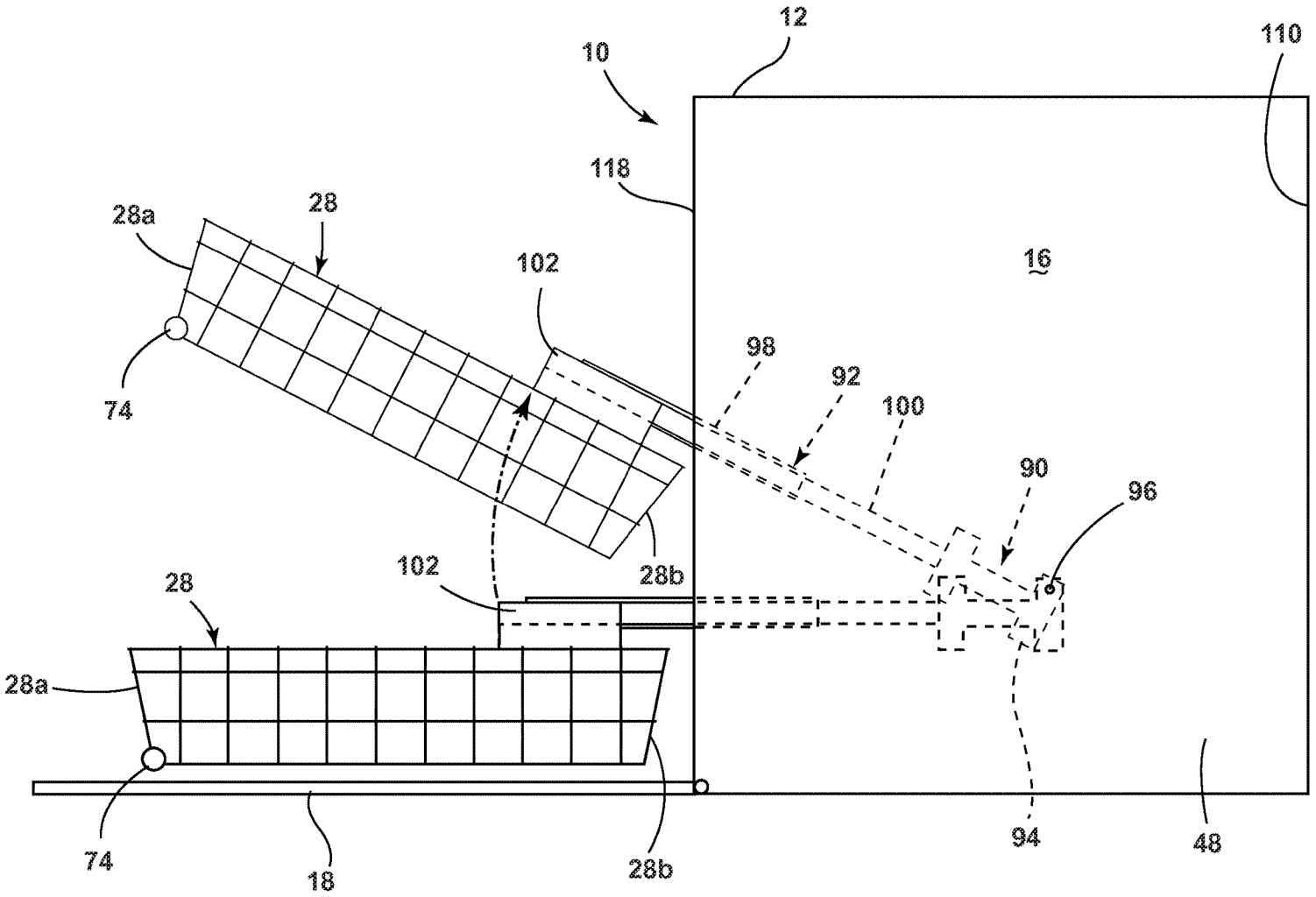
FIG. 7 is a schematic elevation view of a portion of a dishwasher including a dish rack incorporating a dish rack pivot system according to a second embodiment of the invention.

FIG. 7 schematically illustrates a second embodiment of the pivoting dish rack assembly which shares many features of the first embodiment and, therefore, descriptions of like elements will not be repeated, and like elements will be identified with like reference characters. The second embodiment differs from the first embodiment in that, rather than the dish rack 28 pivoting relative to the rails 62, 64, the dish rack 28 remains fixedly oriented relative to the rails, and the rails pivot relative to the tub side walls 48. Nevertheless, the second embodiment includes a pivot system 90 and a slide system 92.

FIG. 7 illustrates the second embodiment pivoting dish rack assembly in both the unpivoted (lower) position and the pivoted (upper) position, with the pivoting movement represented by the upwardly-directed arcuate arrow.

The slide system 92 may include a first rail 98 and a second rail 100. The first rail 98 may be fixedly coupled to a dish rack support bracket 102 using threaded fasteners, rivets, snap fittings, welds, integration, and the like. The dish rack support bracket 102 may be coupled with the dish rack 28 in a suitable manner, such as by attaching the support bracket 102 to the side walls 28*c*. Alternatively, the first rail 98 can be movably coupled with the dish rack support bracket 102 by an assembly of rollers (not shown) to enable movement of the dish rack support bracket 102 along the first rail 98. The first rail 98 may also be adapted for slidable telescopic engagement with the second rail 100.

The second rail 100 may be coupled with the pivot system 90, which may include a first pivot coupling 94 and a second pivot coupling 96. The second pivot coupling 96 may be fixedly attached to a tub side wall 48, and may be pivotably coupled with the first pivot coupling 94 for pivoting of the first pivot coupling 94 relative to the second pivot coupling 96. As an example, the second pivot coupling 96 may include an axle or pin (not shown) and the first pivot coupling 94 may include a hub (not shown) for pivotable register. Thus, the slide system 92 may pivot relative to the side walls 48, with the second rail 100 slidably fixed relative to the tub side wall 48.

With the door assembly 18 open, the lower dish rack 28 may be fully extended out of the treating chamber 16 by telescopic movement of the first rail 98 relative to the second rail 100. As the door assembly 18 is lifted to close the dishwasher 10, the low friction contact element 74 may contact the inner surface of the door assembly 18 so that the lower dish rack 28 may be lifted by inclination of the slide system 92 and pivoting of the first pivot coupling 94 relative to the second pivot coupling 96, enabling the lower dish rack 28 to move along the slide system 92 into the treating chamber 16.

With the first embodiment, lifting of the door assembly 18 may pivot the lower dish rack 28 to an inclined disposition relative to the slide system 60. Pivoting of the dish rack 28 may tend to urge the dish rack 28 into the treating chamber 16. However, the first rail 62 must also horizontally telescope along the second rail 64 for the dish rack 28 to enter the treating chamber 16. With the second embodiment, lifting of the door assembly 18 may pivot the lower dish rack 28 and the slide system 92 upwardly relative to the pivot system 90. The pivoting of the dish rack 28 and the slide system 92 to the same inclination may urge the dish rack 28 into the treating chamber 16 by telescopic movement of the first rail 62 relative to the second rail 64.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

| Parts List | |
|---|---|
| 10 | dishwasher |
| 12 | chassis |
| 14 | tub |
| 16 | treating chamber |
| 18 | door assembly |
| 20 | pump assembly |
| 22 | drain pump |
| 24 | recirculation pump |
| 26 | upper dish rack |
| 26a | rack front wall |
| 26b | rack rear wall |
| 28c | rack side wall |
| 28d | rack bottom wall |
| 28 | lower dish rack |
| 28a | rack front wall |
| 28b | rack rear wall |
| 28c | rack side wall |
| 28d | rack bottom wall |
| 30 | sump |
| 32 | hinge assembly |
| 34 | first lower spray arm assembly |
| 36 | second lower spray assembly |
| 38 | mid-level spray arm assembly |
| 40 | upper spray arm assembly |
| 42 | supply tube |
| 44 | spray manifold |
| 46 | heater |
| 48 | tub side wall |
| 50 | controller |
| 52 | memory |
| 54 | central processing unit |
| 56 | user interface |
| 58 | sensor |
| 60 | slide system |
| 62 | first rail |
| 64 | second rail |
| 66 | transition element |
| 68 | pivot system |
| 70 | |
| 72 | |
| 74 | low-friction contact element |
| 76 | $1^{st}$ pivot coupling |
| 78 | $2^{nd}$ pivot coupling |
| 80 | vertical slider |
| 82 | pin |
| 84 | channel element |
| 86 | hub |
| 88 | axle |
| 90 | pivot system |
| 92 | slide system |
| 94 | first pivot coupling |
| 96 | second pivot coupling |
| 98 | first rail |

-continued

| Parts List | |
|---|---|
| 100 | second rail |
| 102 | rack support bracket |
| 104 | hub |
| 106 | axle |
| 108 | slot |
| 110 | tub back wall |
| 112 | pivot plate |
| 114 | first slide system assembly |
| 116 | |
| 118 | open face |
| 120 | pivot assembly |
| 122 | |
| 124 | $1^{st}$ portion |
| 126 | $2^{nd}$ portion |
| 128 | rack side wall |
| 130 | rack bottom wall |
| 132 | rectangular opening |
| 134 | |
| 136 | flange |
| 138 | weld |

What is claimed is:

1. A dishwasher comprising:

a tub defining a wash chamber with an open face;

a pivoting door having an open position and a closed position;

a slide system having a first rail including a transition element, and a second rail slidably interconnected with the first rail for relative sliding; and a dish rack rotatably connected to the slide system by a pivot system;

wherein the pivot system is operably coupled to the transition element and is configured to cooperatively pivot with the door as the door is moving from the open position to the closed position.

2. The dishwasher of claim 1 wherein the pivot system cooperatively pivots when the dish rack is at least partially overlying the door.

3. The dishwasher of claim 1 wherein the pivot system comprises a first pivot coupling coupled to the dish rack, a second pivot coupling coupled to the slide system, with the first and second pivot couplings being rotationally connected to provide for relative pivoting of the dish rack and slide system.

4. The dishwasher of claim 3 wherein the dish rack comprises opposing side walls and the first pivot coupling is coupled to at least one of the opposing side walls.

5. The dishwasher of claim 4 wherein the first rail is coupled to the first pivot coupling and the second rail is coupled to the tub.

6. The dishwasher of claim 5 wherein the first pivot coupling is mounted to the transition element.

7. The dishwasher of claim 6 wherein the slide system further comprises a vertical slider having a pin mounted to the transition element and the dish rack and a channel element mounted to another the transition element and the dish rack, with the pin slidably received within the channel element.

8. The dishwasher of claim 4 wherein the first pivot coupling is located near a rear portion of the at least one of the opposing side walls.

9. The dishwasher of claim 8 wherein the dish rack comprises a wireframe and the first pivot coupling is mounted to the wireframe.

10. The dishwasher of claim 9 wherein the first pivot coupling is snap-fit to the wireframe.

11. The dishwasher of claim 3 wherein one of the first and second pivot couplings comprises a hub with an opening, and the other of the first and second pivot couplings comprises an axle rotationally mounted within the opening.

12. The dishwasher of claim 1 wherein the pivot system rotationally couples the slide system to the tub.

13. The dishwasher of claim 12 wherein the pivot system comprises a first pivot coupling coupled to the slide system, and a second pivot coupling coupled to the tub, with the first and second pivot couplings being rotationally connected to provide for relative pivoting of the slide system and tub.

14. The dishwasher of claim 13 wherein the tub comprises opposing side walls and the second pivot coupling is coupled to at least one of the opposing side walls.

15. The dishwasher of claim 14 wherein the slide system comprises first and second rails, which are slidably interconnected for relative sliding, with the second rail being coupled to the first pivot coupling and the first rail being coupled to the dish rack.

16. The dishwasher of claim 15 wherein the first pivot coupling is located near a rear portion of the at least one of the opposing side walls.

17. The dishwasher of claim 15 wherein the second rail is slidably fixed relative to the tub.

18. The dishwasher of claim 15 wherein one of the first and second pivot couplings comprises a hub with an opening, and the other of the first and second pivot couplings comprises an axle rotationally mounted within the opening.

19. A dish rack for a dishwasher, comprising:

a slide system comprising a first rail including a transition element and a second rail, wherein the first rail and the second rail are slidably interconnected for relative sliding; and a pivot system rotationally coupling the dish rack to the slide system;

wherein the pivot system is operably coupled to the transition element and is configured to cooperatively pivot with a dishwasher door as the dishwasher door is moving from an open position to a closed position.

* * * * *